US007890035B2

(12) United States Patent
Gotoda

(10) Patent No.: US 7,890,035 B2
(45) Date of Patent: Feb. 15, 2011

(54) IMAGE FORMING APPARATUS AND IMAGE TRANSFERRING METHOD THEREFOR

(75) Inventor: Katsuhiko Gotoda, Hsinchu (TW)

(73) Assignee: Avision Inc. (TW)

( * ) Notice: Subject to any disclaimer, the term of this patent is extended or adjusted under 35 U.S.C. 154(b) by 404 days.

(21) Appl. No.: 12/000,144

(22) Filed: Dec. 10, 2007

(65) Prior Publication Data

US 2009/0148199 A1 Jun. 11, 2009

(51) Int. Cl.
*G03G 15/01* (2006.01)

(52) U.S. Cl. ..... 399/302

(58) Field of Classification Search ..... 399/299, 399/302, 308, 388, 396
See application file for complete search history.

(56) References Cited

U.S. PATENT DOCUMENTS 5,428,430 A * 6/1995 Aslam et al. ..... 399/307
5,797,077 A * 8/1998 Samizo et al. ..... 399/309
6,385,428 B1 * 5/2002 Uchida et al. ..... 399/303
6,408,155 B1 * 6/2002 Tajima et al. ..... 399/298
7,403,727 B2 * 7/2008 Fujimori et al. ..... 399/49
7,643,775 B2 * 1/2010 Lobel ..... 399/167
2003/0063922 A1 * 4/2003 Furumizu ..... 399/149
2004/0131397 A1 * 7/2004 Kikuchi ..... 399/309
2006/0120771 A1 * 6/2006 Mizushima et al. ..... 399/297
2006/0291930 A1 * 12/2006 Moore ..... 399/384
2007/0212126 A1 * 9/2007 Seto et al. ..... 399/302

FOREIGN PATENT DOCUMENTS

JP 2004-118076 4/2004
JP 2007-057648 3/2007

* cited by examiner

*Primary Examiner*—David P Porta
*Assistant Examiner*—Marcus H Taningco

(57) ABSTRACT

An image forming apparatus and an image transferring method therefor are provided. The apparatus includes a plurality of photosensitive units, an intermediate transfer member, and a sheet-conveying unit. Each of the photosensitive units bears a first toner image. The intermediate transfer member is in contact with the photosensitive units, onto which the first toner images are transferred from the photosensitive units and superimposed to form a second toner image. The intermediate transfer member is rotationally driven at a first speed. The sheet-conveying unit is used for transporting a sheet past the intermediate transfer member at a second speed different from the first speed, so that the second toner image on the intermediate transfer member is transferred onto the sheet.

13 Claims, 2 Drawing Sheets

IMAGE FORMING APPARATUS AND IMAGE TRANSFERRING METHOD THEREFOR

BACKGROUND OF THE INVENTION

1. Field of the Invention

The invention relates in general to an image forming apparatus and an image transferring method therefor, and more particularly to an image forming apparatus and an image transferring method therefor for color image.

2. Description of the Related Art

Compared with inkjet printers, laser printers provide very high speed and high quality printing of text and graphics. Therefore, laser printers are commonly utilized as computer peripherals for domestic or commercial use to handle the printing of mass documents.

When the laser printer starts its printing process, firstly, the surface of the photosensitive drum or belt inside the laser printer is charged and exposed to form a latent image. After the photosensitive drum (or belt) having the latent image contacts the toner charged by the development system of the laser printer, the toner develops and adheres to the latent image, and therefore transforms the latent image into a toner image. The toner image is then transferred to a sheet. A fuser assembly applies heat and pressure to fuse the toner image onto the sheet. As the printing is completed, residual particles of the toner left on the photosensitive drum will be removed before the next printing starts.

For color laser printer, the toner that consists of toner particles of different colors is needed. Accordingly, the color laser printer employs several photosensitive drums to attract the toner particles of different colors. To transfer the toner particles from different photosensitive drums to the sheet, an intermediate transfer belt (or an intermediate transfer roller) is disposed between the sheet and the photosensitive drums, so that the toner particles are transferred to the intermediate transfer belt (or the intermediate transfer roller) and then to the sheet.

However, after the toner particles are transferred to the surface of the sheet, the toner particles would come off the sheet easily due to the weak Van der Waal's force. The fusing of the toner particles has to be implemented as soon as possible in case that the toner particles come off the sheet and thus the printing quality is reduced.

SUMMARY OF THE INVENTION

The invention is directed to an image forming apparatus and an image transferring method therefor. The apparatus and the method help the toner image to be firmly adhered to the sheet and provide users with high quality printing documents.

According to the present invention, an image forming apparatus is provided. The apparatus includes a plurality of photosensitive units, an intermediate transfer member, and a sheet-conveying unit. Each of the photosensitive unit bears a first toner image. The intermediate transfer member is in contact with the photosensitive units, onto which the first toner images are transferred from the photosensitive units and superimposed to form a second toner image. The intermediate transfer member is rotationally driven at a first speed. The sheet-conveying unit is used for transporting a sheet past the intermediate transfer member at a second speed different from the first speed, so that the second toner image on the intermediate transfer member is transferred onto the sheet.

According to the present invention, an image transferring method including steps mentioned below is provided. A plurality of first toner images are formed on a plurality of photosensitive units, respectively. The first toner images on the photosensitive units are then transferred to an intermediate transfer member, wherein the first toner images are superimposed on the intermediate transfer member to form a second toner image. The second toner image on the intermediate transfer member is transported at a first speed. A sheet is transported past the transferring unit at a second speed different form the first speed. The second toner image on the intermediate transfer member is transferred onto the sheet.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1A:
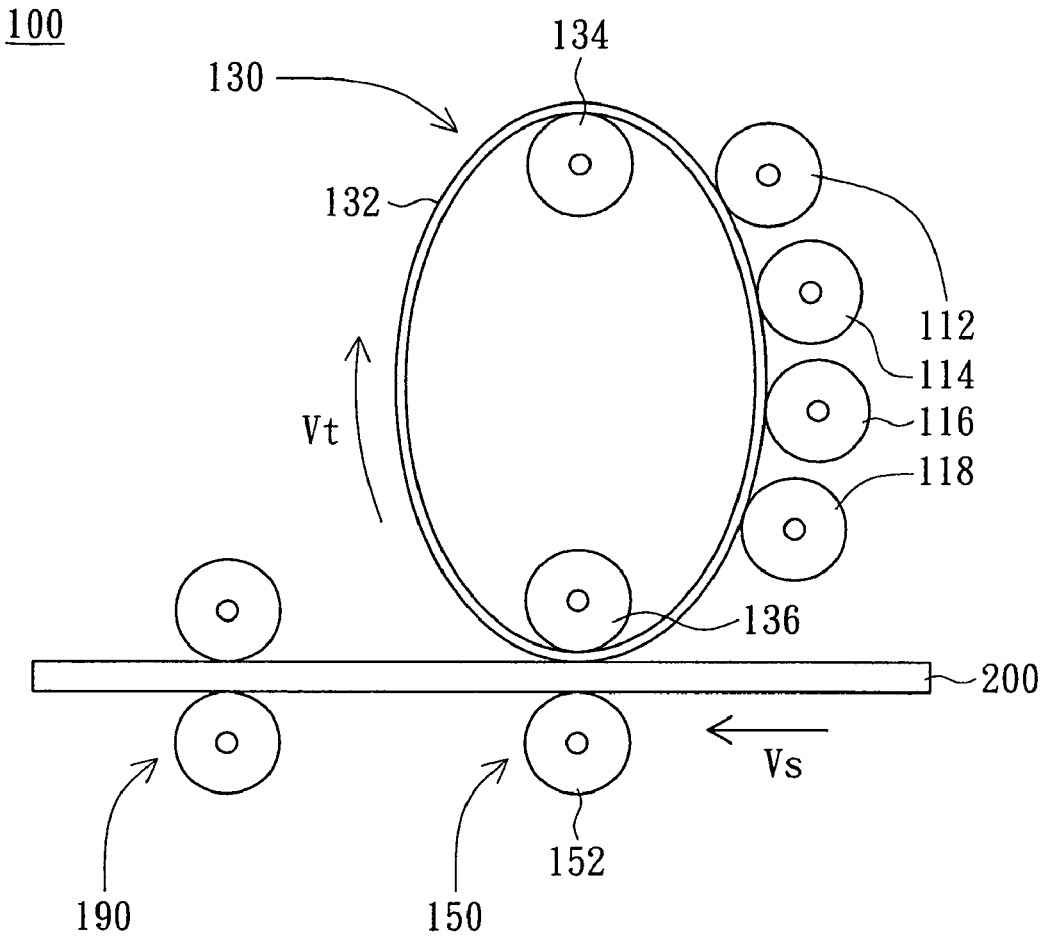
FIG. 1A is a diagram of an image forming apparatus according to a preferred embodiment of the invention.
Figure 1B:
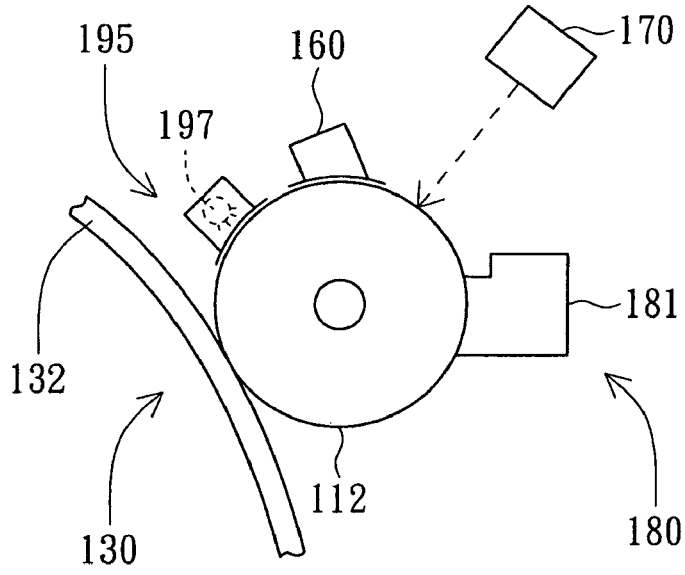
FIG. 1B is a partial diagram of the apparatus in FIG. 1A.

Referring to FIGS. 1A and 1B, FIG. 1A is a diagram of an image forming apparatus according to a preferred embodiment of the invention, and FIG. 1B is a partial diagram of the apparatus in FIG. 1A. The image forming apparatus 100 includes a plurality of photosensitive units, such as four photosensitive units 112, 114, 116, and 118, an intermediate transfer member 130, and a sheet-conveying unit 150. Each of the photosensitive units 112, 114, 116, and 118 bears a first toner image. The intermediate transfer member 130 is in contact with the photosensitive units 112, 114, 116, and 118, onto which the first toner images are transferred from the photosensitive units 112, 114, 116, and 118 and superimposed to form a second toner image. The intermediate transfer member 130 is rotationally driven at a first speed Vt. The sheet-conveying unit 150 is used for transporting a sheet 200 past the intermediate transfer member 130 at a second speed Vs different from the first speed Vt, so that the second toner image on the intermediate transfer member 130 is transferred onto the sheet 200.

The apparatus 100 further includes a charging unit 160 for uniformly charging the surface of each of the photosensitive units 112, 114, 116, and 118 (only photosensitive unit 112 is shown in FIG. 1B for illustration).

Moreover, the apparatus 100 includes a light source 170 for emitting light to the photosensitive units 112, 114, 116, and 118 according to an image signal so as to change a charge distribution on each of the photosensitive units 112, 114, 116, and 118 and form a latent image on each of the photosensitive unit 112, 114, 116, and 118. Take photosensitive unit 112, for example. The light source is, for example, a laser for emitting a laser beam to the photosensitive unit 112. As the surface of the photosensitive unit 112 is uniformly charged by the charging unit 160, the laser is turned on and off according to the image signal to form dots on the photosensitive unit 112. Therefore, the latent image is formed.

The apparatus 100 includes a developing unit 180 for transforming the latent images on the photosensitive unit 112, 114, 116, and 118 into the first toner images. Take the photosensitive unit 112 for example. The developing unit 180 has an agent provider 181 for providing the agent to the photosensitive unit 112. The agent includes the toner particles of different colors. The toner particles of different colors are disposed in different ink cartridges. The agent has, for example, cyan particles, magenta particles, yellow particles, and black particles in the embodiment. Therefore, there are four ink cartridges for loading the cyan particles, magenta particles, yellow particles, and black particles.

Each of the photosensitive units 112, 114, 116, and 118 bears a first toner image that is formed by one-color particles mentioned above. Preferably, each of the photosensitive units 112, 114, 116, and 118 includes a photoconductive drum. For example, the photoconductive drum of the photosensitive unit 112 is for attracting the cyan particles in the ink cartridge of the agent provider 181 to form a cyan image. The photoconductive drum of the photosensitive unit 114 is for attracting the magenta particles to form a magenta image. The photoconductive drum of the photosensitive unit 116 is for attracting the yellow particles to form a yellow image. The photoconductive drum of the photosensitive unit 118 is for attracting the black particles to form a black image. The cyan image, magenta image, yellow image, and black image are the first toner images on the photosensitive units 112, 114, 116, and 118, respectively.

As for the intermediate transfer member 130, it includes an intermediate transfer belt (ITB) 132. The ITB 132 is movably disposed in the apparatus 100 and is driven by a first roller 134 and a second roller 136 for rotation. The ITB 132 is in contact with the four photosensitive units 112, 114, 116, and 118. Therefore, the first toner images on the photosensitive units 112, 114, 116, and 118 are transferred to the ITB 132 and superimposed to form the second toner image on the ITB 132. Although the ITB 132 is employed in the embodiment, the invention is not limited thereto. The intermediate transfer member 130 can include an intermediate transfer roller (ITR) for being in contact with the photosensitive units 112, 114, 116, and 118 at the same time in other embodiments.

The sheet-conveying unit 150 includes a third roller 152 and a conveying mechanism (not shown). The third roller 152 is adjacent to the second roller 136. The second roller 136 leans against the ITB 132 for pressing the ITB 132 to the sheet 200. The conveying mechanism is used for transporting the sheet 200 as well as guiding the sheet 200 to pass through the gap between the second roller 136 and the third roller 152. As the sheet 200 passes through the gap, the sheet 200 contacts the ITB 132 so that the second toner image on the ITB 132 is transferred to the sheet 200.

The second speed Vs of transporting the sheet 200 is different from the first speed Vt of the ITB 132. The second speed Vs of the sheet 200 can be smaller than or greater than the first speed Vt of the ITB 132. With the speed difference of the speed Vs and Vt and the friction between the sheet 200 and ITB 132, a shear force is generated between the sheet 200 and ITB 132 accordingly. The shear-force helps the toner particles of the second toner image to be firmly adhered to the sheet 200. Preferably, the first speed Vt is substantially 92% to 98% of the second speed Vs. Or, the first speed Vt is substantially 102% to 110% of the second speed Vs.

After the second toner image is transferred onto the sheet 200, it is necessary to ensure the toner particles of the second toner image stay on the sheet 200. Preferably, the apparatus 100 further includes a fusing unit 190 for fusing the second toner image onto the sheet 200. The fusing unit 190 can be a fuser assembly with rollers that are disposed around the second roller 136 and the third roller 152. As the sheet 200 passes through the gap between the second roller 136 and the third roller 152 and then through the fuser assembly, the fuser assembly provides heat and pressure to the sheet 200 uniformly, such that the toner particles of the second toner image are properly bonded on the sheet 200.

Afterwards, the toner particles left on the photosensitive units 112, 114, 116, 118 and the ITB 132 should be removed since they are excess particles and cannot be reused again. Therefore, the apparatus 100 further includes a cleaning unit 195 for removing residual particles on the photosensitive units 112, 114, 116, 118 and the ITB 132. Take photosensitive unit 112 for example. As shown in FIG. 1B, the cleaning unit 195 preferably includes a discharge lamp 197 to remove the remaining charge on the photosensitive unit 112, so that the residual particles are no longer attracted to the photosensitive unit 112. The cleaning unit 195 can also has soft plastic blades (not shown) to wipe off the residual particles from the photosensitive unit 112 and deposit them into a waste reservoir (not shown).

Figure 2:
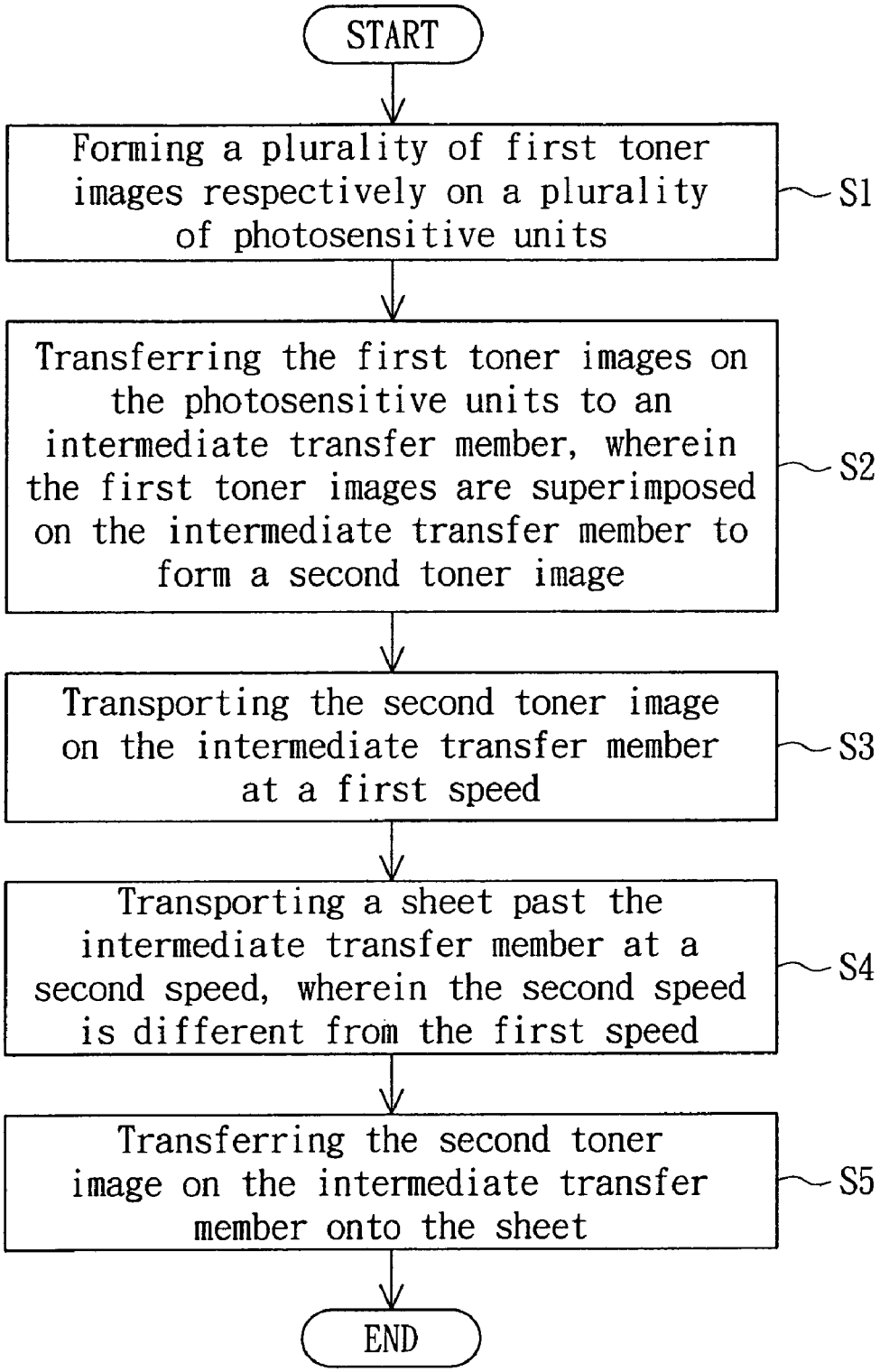
FIG. 2 is a flowchart showing the steps of an image transferring method according to a preferred embodiment of the invention.

Referring to FIG. 2, it is a flowchart showing the steps of an image transferring method according to a preferred embodiment of the invention. The method includes the steps S1 to S5: forming a plurality of first toner images respectively on a plurality of photosensitive units in step S1; transferring the first toner images on the photosensitive units to an intermediate transfer member, wherein the first toner images are superimposed on the intermediate transfer member to form a second toner image in step S2; transporting the second toner image on the intermediate transfer member at a first speed in step S3; transporting a sheet past the intermediate transfer member at a second speed, wherein the second speed is different from the first speed step S4; and transferring the second toner image on the intermediate transfer member onto the sheet in step S5.

Please refer to FIGS. 1A, 1B and 2. In step S1, the surfaces of the four photosensitive units 112, 114, 116, and 118 are uniformly charged. A laser emits laser beams to the four photosensitive units 112, 114, 116 and 118 according to an image signal so as to change the charge distribution of the charges on the photosensitive units 112, 114, 116 and 118 and form a latent image on each surface of the photosensitive units 112, 114, 116 and 118. Via the agent provided by the agent provider, each of the photosensitive units 112, 114, 116, and 118 then attracts the toner particles of the agent to transforming the latent image into the first toner image.

In step S2, the first toner images on the photosensitive units 112, 114, 116, and 118 are transferred to the intermediate transfer member 130 and superimposed to form the second toner image.

From the step S3 to step S5, the first speed Vt of the intermediate transfer member 130 is substantially 92% to 98% of the second speed Vs of transporting the sheet 200. Also, the first speed Vt can be substantially 102% to 110% of the second speed Vs.

For firmly fixing the second toner image onto the sheet 200, the method further includes the step of fusing the second toner image onto the sheet 200 after the step S5. After the fusing is completed, the residual particles on the photosensitive units 112, 114, 116, 118 and intermediate transfer member 130 can be removed by the cleaning unit 195.

In the conventional color laser printer, toner particles are adhered to a sheet only via the weak Van der Waal's force of the toner particles. The image forming apparatus and the image transferring method according to the preferred embodiment of the invention disclosed above make use of speed difference between the speed of transporting a sheet and that of the intermediate transfer member, such that a shear force is generated between the sheet and the intermediate transfer member to help the toner image to be firmly adhered to the sheet. As the toner image is firmly fixed onto the sheet, the toner particles of the toner image will not come off the sheet easily, so that the toner image on the sheet can faithfully present the details of text or graphics on the document or object to be scanned. Therefore, the image quality is highly increased.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An image forming apparatus, comprising:

a plurality of photosensitive units each for bearing a first toner image;

an intermediate transfer member being in contact with the photosensitive units and rotationally driven at a first speed, wherein the first toner images are transferred from the photosensitive units to the intermediate transfer member and superimposed to form a second toner image on the intermediate transfer member; and a sheet-conveying unit for transporting a sheet past the intermediate transfer member at a point of transfer of the second toner image from the intermediate transfer member to the sheet at a second speed different from the first speed.

2. The apparatus according to claim 1, wherein the first speed is substantially 92% to 98% of the second speed.

3. The apparatus according to claim 1, wherein the first speed is substantially 102% to 110% of the second speed.

4. The apparatus according to claim 1, wherein the first toner images are toner images of different colors.

5. The apparatus according to claim 1, wherein the intermediate transfer member comprises an intermediate transfer belt.

6. The apparatus according to claim 1, wherein the intermediate transfer member comprises an intermediate transfer roller.

7. The apparatus according to claim 1, wherein each of the photosensitive units comprises a photoconductive drum.

8. The apparatus according to claim 1, further comprising a fusing unit for fusing the second toner image on the sheet.

9. An image transferring method, comprising:

forming a plurality of first toner images respectively on a plurality of photosensitive units;

transferring the first toner images on the photosensitive units to an intermediate transfer member, wherein the first toner images are superimposed on the intermediate transfer member to form a second toner image;

transporting the second toner image on the intermediate transfer member at a first speed;

transporting a sheet past the intermediate transfer member at a point at a second speed, wherein the second speed is different from the first speed; and transferring at the point the second toner image on the intermediate transfer member onto the sheet.

10. The method according to claim 9, wherein the step of transporting the second toner image on the intermediate transfer member at the first speed comprises:

transporting the second toner image on the intermediate transfer member at the first speed, which is substantially 92% to 98% of the second speed.

11. The method according to claim 9, wherein the step of transporting the second toner image on the intermediate transfer member at the first speed comprises:

transporting the second toner image on the intermediate transfer member at the first speed, which is substantially 102% to 110% of the second speed.

12. The method according to claim 9, wherein the first toner images formed on the photosensitive units are toner images of different colors.

13. The method according to claim 9, further comprising:

fusing the second toner image on the sheet.

* * * * *